US006454630B1

(12) United States Patent
Tolles

(10) Patent No.: US 6,454,630 B1
(45) Date of Patent: Sep. 24, 2002

(54) ROTATABLE PLATEN HAVING A TRANSPARENT WINDOW FOR A CHEMICAL MECHANICAL POLISHING APPARATUS AND METHOD OF MAKING THE SAME

(75) Inventor: Robert D. Tolles, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/662,145

(22) Filed: Sep. 14, 2000

Related U.S. Application Data

(60) Provisional application No. 60/153,668, filed on Sep. 14, 1999.

(51) Int. Cl.[7] ..... B24B 1/00

(52) U.S. Cl. ..... 451/6; 451/41; 451/287; 451/526

(58) Field of Search ..... 451/6, 921, 285–289, 451/41, 60, 526, 5, 8, 9

(56) References Cited

U.S. PATENT DOCUMENTS

| | | | | |
|---|---|---|---|---|
| 6,045,439 A | * | 4/2000 | Birang et al. | 451/6 |
| 6,068,539 A | | 5/2000 | Bajaj et al. | |
| 6,146,248 A | * | 11/2000 | Jairath et al. | 451/41 |
| 6,254,459 B1 | * | 7/2001 | Bajaj et al. | 451/41 |
| 6,280,289 B1 | * | 8/2001 | Wiswesser et al. | 451/6 |
| 6,280,290 B1 | * | 8/2001 | Birang et al. | 451/6 |

* cited by examiner

*Primary Examiner*—George Nguyen
(74) *Attorney, Agent, or Firm*—Moser, Patterson & Sheridan

(57) ABSTRACT

An arrangement for polishing a workpiece in a chemical mechanical polishing apparatus has a rotatable platen with an aperture that allows a laser interferometric measuring device to measure the surface condition of a workpiece being polished. A transparent block is flexibly attached to the top surface of the platen over the platen aperture to rotate with the platen. A polishing pad is disposed on the top surface of the platen, and has a hole extending through the pad configured to fit over the transparent block attached to the platen.

33 Claims, 3 Drawing Sheets

ROTATABLE PLATEN HAVING A TRANSPARENT WINDOW FOR A CHEMICAL MECHANICAL POLISHING APPARATUS AND METHOD OF MAKING THE SAME

This application claims the benefit of U.S. provisional application No. 60/153,668, filed Sep. 14, 1999.

FIELD OF THE INVENTION

This invention relates generally to semiconductor manufacture, and more particularly to a method for forming a transparent window in a polishing pad for use in chemical mechanical polishing (CMP).

BACKGROUND OF THE INVENTION

In the process of fabricating modem semiconductor integrated circuits (ICs), it is necessary to form various material layers and structures over previously formed layers and structures. However, the prior formations often leave the top surface topography of an inprocess wafer highly irregular, with bumps, areas of unequal elevation, troughs, trenches, and/or other surface irregularities. These irregularities cause problems when forming the next layer. For example, when printing a photolithographic pattern having small geometries over previously formed layers, a very shallow depth of focus is required. Accordingly, it becomes essential to have a flat and planar surface, otherwise, some parts of the pattern will be in focus and other parts will not. In fact, surface variations on the order of less than 1000 Å over a 25×25 mm die would be preferable. In addition, if the irregularities are not leveled at each major processing step, the surface topography of the wafer can become even more irregular, causing further problems as the layers stack up during further processing. Depending on the die type and the size of the geometries involved, the surface irregularities can lead to poor yield and device performance. Consequently, it is desirable to effect some type of planarization, or leveling, of the IC structures. In fact, most high density IC fabrication techniques make use of some method to form a planarized wafer surface at critical points in the manufacturing process.

One method for achieving semiconductor wafer planarization or topography removal is the chemical mechanical polishing (CMP) process. In general, the chemical mechanical polishing (CMP) process involves holding and/or rotating the wafer against a rotating polishing platen under a controlled pressure. As shown in FIG. 1, a typical CMP apparatus 10 includes a polishing head 12 for holding the semiconductor wafer 14 against the polishing platen 16. The polishing platen 16 is covered with a pad 18. This pad 18 typically has a backing layer 20 which interfaces with the surface of the platen and a covering layer 22 which is used in conjunction with a chemical polishing slurry to polish the wafer 14. However, some pads have only a covering layer and no backing layer. The covering layer 22 is usually either an open cell foamed polyurethane (e.g. Rodel IC1000) or a sheet of polyurethane with a grooved surface (e.g. Rodel EX2000). The pad material is wetted with the chemical polishing slurry containing both an abrasive and chemicals. One typical chemical slurry includes KOH (Potassium Hydroxide) and fumed-silica particles. The platen is usually rotated about its central axis 24. In addition, the polishing head is usually rotated about its central axis 26, and translated across the surface of the platen 16 via a translation arm 28. Although just one polishing head is shown in FIG. 1, CMP devices typically have more than one of these heads spaced circumferentially around the polishing platen.

A particular problem encountered during a CMP process is in the determination that a part has been planarized to a desired flatness or relative thickness. In general, there is a need to detect when the desired surface characteristics or planar condition has been reached. This has been accomplished in a variety of ways. Early on, it was not possible to monitor the characteristics of the wafer during the CMP process. Typically, the wafer was removed from the CMP apparatus and examined elsewhere. If the wafer did not meet the desired specifications, it had to be reloaded into the CMP apparatus and reprocessed. This was a time consuming and labor-intensive procedure. Alternatively, the examination might have revealed that an excess amount of material had been removed, rendering the part unusable. There was, therefore, a need in the art for a device which could detect when the desired surface characteristics or thickness had been achieved, in-situ, during the CMP process.

Several devices and methods have been developed for the in-situ detection of endpoints during the CMP process. For instance, devices and methods that are associated with the use of ultrasonic sound waves, and with the detection of changes in mechanical resistance, electrical impedance, or wafer surface temperature, have been employed. These devices and methods rely on determining the thickness of the wafer or a layer thereof, and establishing a process endpoint, by monitoring the change in thickness. In the case where the surface layer of the wafer is being thinned, the change in thickness is used to determine when the surface layer has the desired depth. And, in the case of planarizing a patterned wafer with an irregular surface, the endpoint is determined by monitoring the change in thickness and knowing the approximate depth of the surface irregularities. When the change in thickness equals the depth of the irregularities, the CMP process is terminated. Although these devices and methods work reasonably well for the applications for which they were intended, there is still a need for systems which provide a more accurate determination of the endpoint.

One such system employs a CMP apparatus in which a hole is formed in a platen and the overlying platen pad. The hole is positioned so that it has a view of the wafer held by a polishing head during a portion of the platen's rotation. A laser interferometer is fixed below the platen in a position enabling the laser beam projected by the laser interferometer to pass through the hole in the platen and strike the surface of the overlying wafer during the time when the hole is adjacent to the wafer. Various polishing pad embodiments include a transparent window in the pad. One of the concerns with the disclosed polishing pad arrangements is the leakage of slurry into the hole below the window of the polishing pad. This is a serious concern because any more than a trace amount of slurry will tend to scatter the light traveling through it, thus attenuating the laser beam emitted from the laser interferometer. The slurry leakage will thus cause inaccurate measurements with a laser interferometer, or even inoperability of the device.

In one method for detecting the end point in an in-situ polishing process, a platen is provided with a hole, or aperture, through which a laser interferometer is able to transmit laser light to the surface of the wafer being polished. The pad is configured with a transmissive portion that is positioned over the aperture and the rotatable platen. Thus, a relatively clear path to the wafer surface is provided by the combination of the platen and the pad. In one embodiment, the platen hole is formed with a stepped diameter to form a shoulder. A quartz insert is contained within the shoulder and functions as a window for the laser beam. The interface between the platen and the insert is sealed. The quartz insert protrudes above the top surface of the platen and partially into the platen pad in order to minimize the gap between the top surface of the insert and the surface of the wafer. This minimizes the amount of slurry trapped in the gap, thus reducing the attenuation of the laser beam emitted from the laser interferometer. It is desirable to make the gap as small as possible to reduce the amount of slurry in the gap. The fixing of the quartz insert within the platen is a concern, however since the wear of the pad could become so great that the top surface of the insert would touch the wafer and damage the wafer. In order to overcome this problem, another embodiment of the arrangement provides a polishing pad that has an integral window. For example, the window may be made of a polyurethane material that will not scratch the wafer and is co-planar with the top surface of the polishing pad. One of the disadvantages of the polishing pad provided with the integral window is the precise registration of the window pad over the aperture in the platen. The precision placement of the window over the aperture by an operator during the replacement of a pad may be time consuming and reduces overall production throughput. Also the polishing pads may be relatively expensive and more difficult to make since they contain a window that must be precisely inserted and fixed within the pad. Since the polishing pads are a major consumable item of the chemical mechanical polishing apparatus, this relatively more complex pad, which needs to be precisely assembled, will increase the operating cost of the apparatus.

SUMMARY OF THE INVENTION

There is a need for an arrangement in a chemical mechanical polishing apparatus in which a laser interferometer may be used to measure the condition of a wafer being polished, but reduces the cost of the individual polishing pads that are used.

This and other needs are met by an embodiment of the present invention which provides an arrangement for a polishing a workpiece in a chemical mechanical polishing apparatus. The arrangement includes a rotatable platen having a planar top surface, a bottom surface, and an aperture extending through the platen providing a transparent channel through the platen. A transparent block is flexibly attached to the top surface of the platen over the platen aperture to rotate with the platen. A polishing pad is provided on the top surface of the platen. This polishing pad has a planar bottom surface and a hole extending through the pad. The hole is configured to fit over the transparent block.

One of the advantages of the arrangement of the present invention is that a polishing pad may be provide that is relatively inexpensive to manufacture since the transparent block does not form part of the pad. Instead, a conventional polishing pad may be modified by cutting a hole through the pad, as long as its hole is configured to fit over the transparent block. Since the transparent block is attached to the top surface of the platen, and remains with the platen, relatively inexpensive polishing pads that do not include a transparent block may be used. Another advantage of the present invention is that provided by the flexible attachment of the transparent block to the top surface of the platen. The transparent block may thus move downwardly when the wafer is placed against the emulsion pad. In other words, the transparent block may move downwardly simultaneously with the compressing of the polishing pad under the force exerted by the wafer during a polishing operation. Hence, while saving money by using relatively inexpensive polishing pads, the present invention provides a transparent block that has a top surface that may be co-planar with the top surface of the polishing pad, since the transparent block may move downwardly due to the flexible attachment.

The earlier stated needs are also met by another embodiment of the present invention which provides a planar for a chemical mechanical polishing apparatus. The platen comprises a plainer top surface configured for supporting a polishing pad and a bottom surface. An aperture extends through the platen to provide a transparent channel through the platen between the bottom surface and the top surface. The transparent block is flexibly attached independently of the polishing pad to the top surface of the platen over the platen aperture to rotate with the platen.

The earlier stated needs are also met by another embodiment of the present invention which provides a polishing pad for a chemical mechanical polishing apparatus that has a rotatable platen with an aperture and a transparent block attached by a flexible coupling to the platen over the aperture. The polishing pad comprises a planar bottom surface preceding the polishing pad on a rotatable platen. The planar top surface forms a polishing surface for polishing a workpiece. A hole is provided which extends through the polishing pad and opens at the top surface and the bottom surface. The whole has a first portion which is configured to fit snugly around a flexible coupling, as well as a second portion configured to fit snugly around the transparent block.

One of the advantages of the polishing pad of the present invention is its relative low cost, but at the same time, however, the polishing pad may be used in a system that employs laser interferometry in a chemical mechanical polishing apparatus to measure the polishing conditions of a wafer. The polishing pad is especially adapted for fitting snugly around a flexible coupling and around a transparent block.

The earlier stated needs are also met by another embodiment of the present invention which provides a method for forming a platen and polishing pad arrangement for chemical mechanical polishing apparatus. In this method, a transparent block is flexibly attached to a rotatable platen over an aperture of the platen to form a straight transparent channel through the platen and the block. Subsequently, a polishing pad is fitted over the transparent block and onto the platen such that the transparent channel extends completely through the polishing pad.

DETAILED DESCRIPTION OF THE INVENTION

The present invention reduces the costs of polishing pads used in chemical mechanical polishing apparatuses having laser interferometric measuring apparatuses that measure the condition of a wafer being polished. The present invention provides a rotatable platen to which a transparent block is fixed by a flexible coupling. This allows a relatively inexpensive polishing pad to be used since it does not contain a transparent block. The present invention provides that the polishing pad has a hole that fits snugly around the transparent block and the flexible coupling when the polishing pad is placed on the platen. The flexible coupling assures that the transparent block may be moved downwardly toward the platen when compressed by the pressing of the wafer against the polishing pad during polishing operations.

Figure 1:
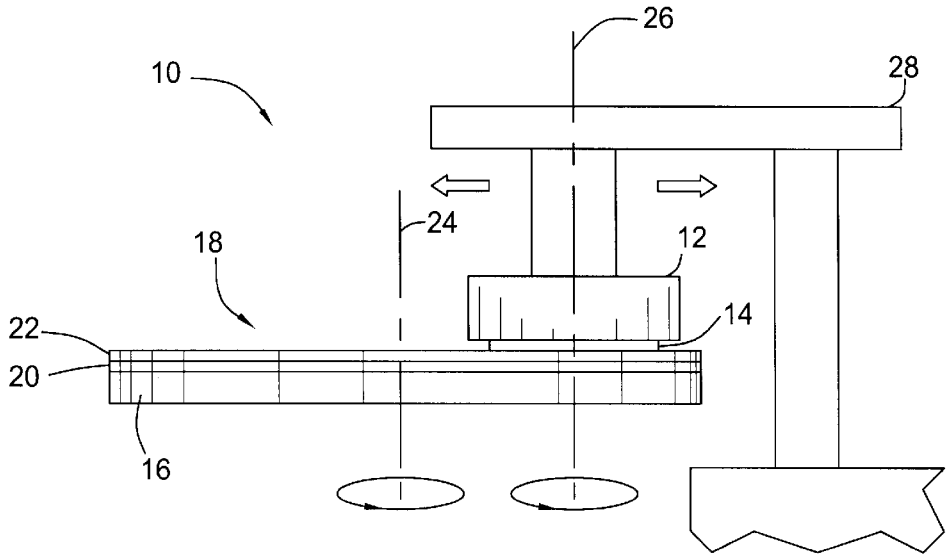
FIG. 1 PRIOR ART
FIG. 1 is a side view of a chemical mechanical polishing (CMP) apparatus typical of the prior art.
Figure 2:
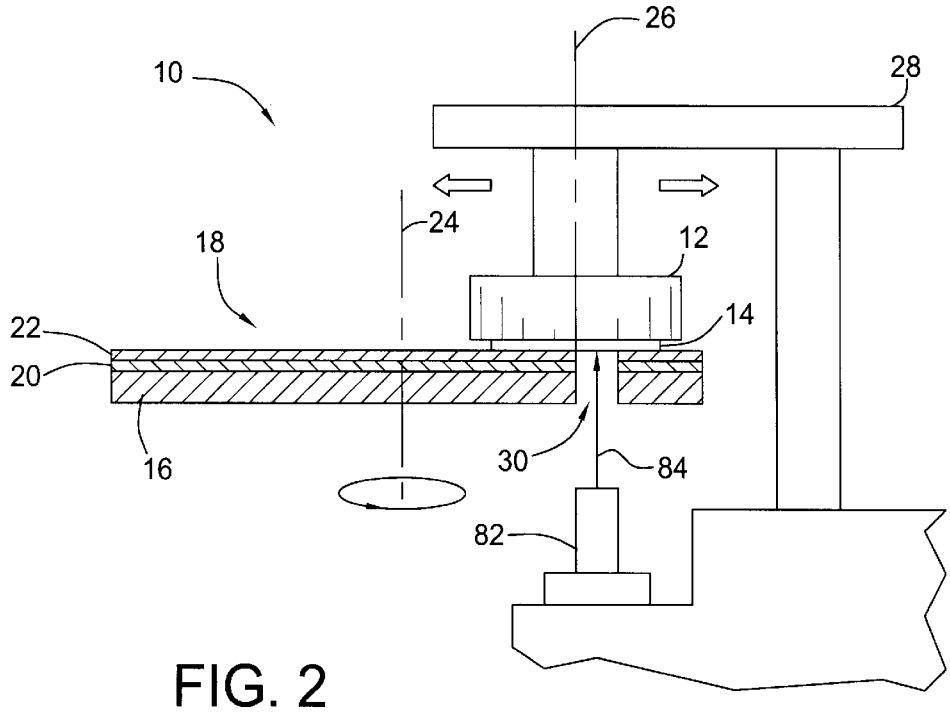
FIG. 2. is a side view of a chemical mechanical polishing apparatus with endpoint detection constructed in accordance with the present invention.

FIG. 2 depicts a portion of CMP apparatus modified in accordance with one embodiment of the present invention. The hole 30 is formed in the platen 16 and the overlying platen pad 18. This hole 30 is positioned such that it has a view of the wafer 14 held by a polishing head 12 during a portion of the platen's rotation, regardless of the translational position of the head 12. A laser interferometer 82 is fixed below the platen 16 in a position enabling a laser beam 84 projected by the laser interferometer 82 to pass through hole 30 in the platen 16 and strike the surface of the overlying wafer during a time when the hole 30 is adjacent to wafer 14.

Figure 3:
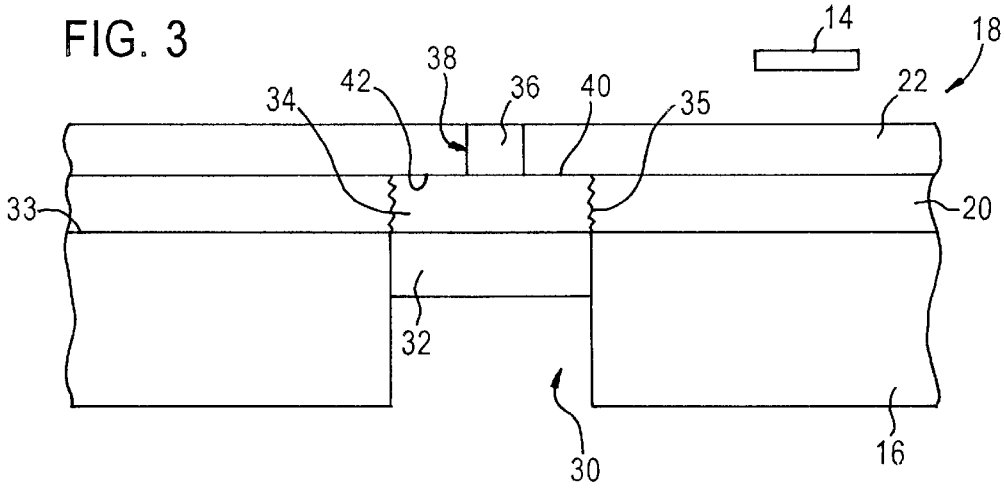
FIG. 3 is a simplified cross-sectional view of an embodiment of the window portion of the apparatus of FIG. 2.

A detailed view of the platen hole 30 is depicted in FIG. 3. The platen 16 includes a hole 30 (hereinafter referred to as aperture 30) and a transparent platen window 32 through which laser light may pass through the platen 16. The platen window 32 is co-planar with the top surface 33 of the platen 16. The platen window 32 therefore seals the aperture 30 from any slurry that may reach the top surface 33 of the platen 16.

Attached to the platen 16 is a flexible coupling 34. The flexible coupling may be a hollow member with side walls 35 and a support surface 40. The side walls 35 are attached at the bottom to the top surface 33 of the platen 16. Side walls 35, in preferred embodiments of the invention, extend around the aperture 30 and the platen window 32. The support surface 40 is connected to the tops of the side walls 35. Support surface 40 provides a surface on which a transparent block 36 is fixed. Hence, after assembly of the platen 16, a rotatable platen with a transparent block that rotates with the platen and is flexibly coupled with the platen is provided.

A polishing pad 18 is mountable on the top surface 33 of the platen 16. The polishing pad 18 has a hole 38 that fits snugly around the flexible coupling 34 and the transparent block 36. The polishing pad 18 may comprise, and preferred embodiments, a backing layer 20 and a covering layer 22. The backing layer 20 may be a felted polyurethane, such as a SUBA-IV layer produced by Rodel. The covering layer 22 may be open cell polyurethane such as IC 1000 produced by Rodel. Alternatively, the polishing pad 18 may comprise a single layer.

The polishing pad 18 has a hole 38 configured, as mentioned above, to fit snugly around the transparent block 36 and the flexible coupling 34 when the polishing pad 18 is placed on the top surface 33 of the platen 16. A portion of the covering layer 22 is pressed against a portion of the support surface 40 that is not covered by the transparent block 36. This portion of the support surface 40 may be coated with a pressure sensitive adhesive so that the covering layer 22 will form an attachment to the flexible coupling 34.

Figure 4:
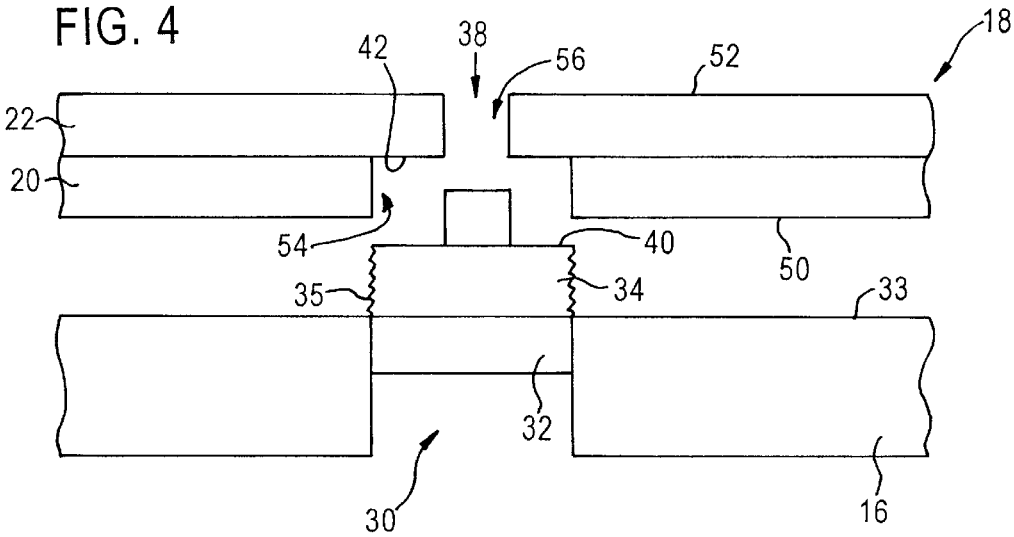
FIG. 4 is a cross-sectional view of the embodiment of the window portion of FIG. 3, prior to assembly of the polishing pad onto the platen, flexible coupling and transparent block in accordance with an embodiment of the method of the present invention.

FIG. 4 depicts the platen 16 and the pad 18 prior to the placement of the pad 18 on the top surface of the platen 16. The pad 18 contains a hole 38 that has a first portion 54 and a second portion 56. The bottom surface of the pad 50 will contact and adhere to the top surface 33 of the platen 16. The top surface of the pad 52 acts as the polishing surface for the wafers. The first portion of the hole 54 is sized to fit snugly around the flexible coupling 34. The second portion of the hole 56 is sized to fit snugly around the transparent block 36.

Since the polishing pad 18 does not contain the transparent block itself, it may be simply prepared from a conventional pad by cutting out the hole 38.

One of the advantages of flexibly attaching the transparent block 36 to the platen 16 rather than using a polishing pad that already contains an attached transparent block, is that a registration of the transparent block portion of the polishing pad with the aperture in the platen is no longer a concern. Automatic registration will be provided by the present invention as the polishing pad is placed over the flexible coupling 34 and the transparent block 36, when polishing pad 18 is positioned on the top surface 33 of the platen 16. Hence, the flexible coupling 34 and the transparent block 36 act as an alignment device for the precise placement of the polishing pad 18 on the platen 16.

Figure 5A:
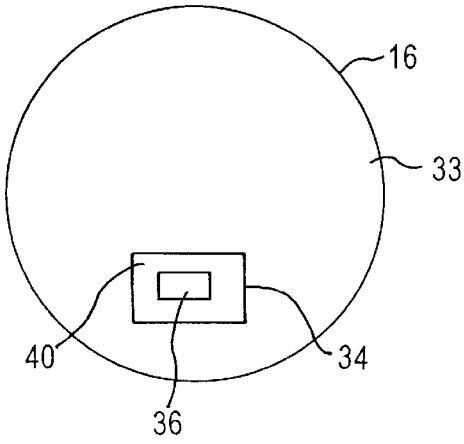
FIG. 5*a* is a top view of the rotatable platen prior to placement of a polishing pad on the platen.
Figure 5B:
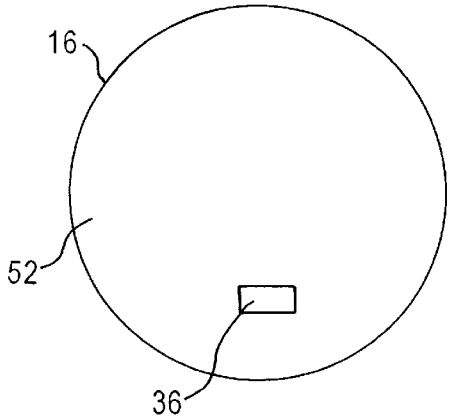
FIG. 5*b* is a top view of the platen of FIG. 5*a* after a polishing pad has been placed on the platen in accordance with an embodiment of the method of the present invention.

FIG. 5*a* is a top view depicting the platen 16. The flexible coupling 34 and the transparent block 36 are positioned on the platen top surface 33. FIG. 5*b* depicts the same top view as in FIG. 5*a*, but after the polishing pad 18 has been placed on the top surface 33 of the platen 16. The polishing surface 52 is visible in the figure, as well as the top surface of the transparent block 36. As seen best in FIG. 3, the top of the transparent block 36 is co-planar with the top surface 52 of the polishing pad 18. The transparent block may be made of a clear polyurethane so that it will not damage the wafer 14 as it is being polished, since it is made of the same material as the top surface 52 of the polishing pad 18.

Another advantage of the present invention is that the top surface of the transparent block 36 is co-planar with the top surface 52 of the polishing pad 18. This feature prevents excessive slurry from remaining above the transparent block as may otherwise occur in arrangements in which the top surface of the transparent block is below the level of the polishing surface. However, in order to accommodate the pressures exerted by the wafer as it is being polished, the present invention provides a flexible coupling 34, shown in more detail in the embodiments of FIGS. 6*a*–6*b* and FIGS. 7*a*–7*b*. These flexible couplings allow the transparent block to be compressed downwardly toward the platen 16 when the polishing pad 18 is compressed. Although two different embodiments of the flexible coupling 34 are depicted, other flexible couplings may be used without departing from the scope of the present invention.

Figure 6A:
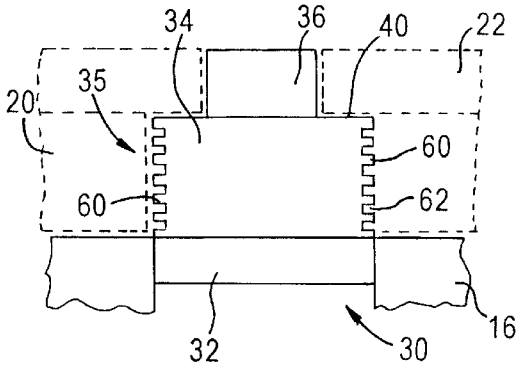
FIG. 6*a* is a cross-sectional detail of the flexible coupling in accordance with one embodiment of the present invention.
Figure 6B:
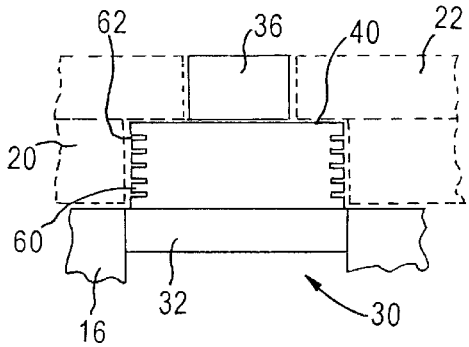
FIG. 6*b* depicts the flexible coupling of FIG. 6*a* in a compressed state in response to loading on a top surface of the polishing pad and transparent block.

FIG. 6*a* depicts a first embodiment of the flexible coupling. 34 in which the side walls of the flexible coupling. 34 include fingers 60 with slot 62 cut out between the finger 60. The finger 60 and slot 62 are located on the side walls 35 of the flexible coupling 34. FIG. 6*a* depicts the flexible coupling 34 and transparent block 36 in a non-compressed state. FIG. 6*b* depicts the flexible coupling 34 in a compressed state. The fingers 60 are compressed towards one another, narrowing the slot 62 between the fingers 60. Exemplary materials for the flexible coupling. 34 are polyurethanes, plastics, elastomeric materials, etc.

Figure 7A:
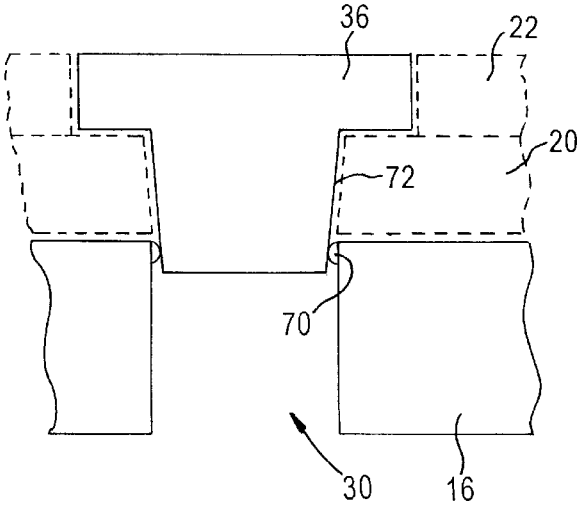
FIG. 7*a* depicts another embodiment of a flexible coupling according to the present invention.
Figure 7B:
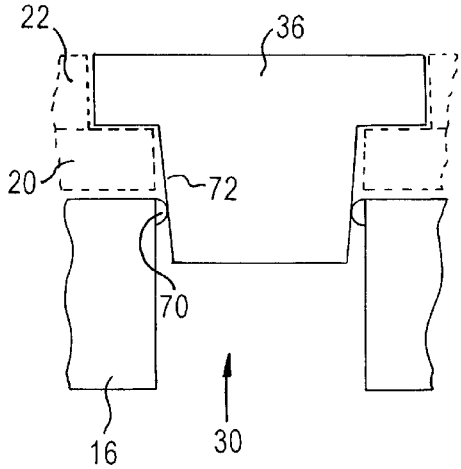
FIG. 7*b* depicts the cross-sectional view of the flexible coupling of FIG. 7*a* with the transparent block compressed into the platen.

FIG. 7*a* depicts alternative embodiments of the present invention in which the flexible coupling 34 is formed by a seal 70 located within the aperture 30 of the platen 16. The seal 70 may take the form of an O-ring, for example. In this embodiment, the transparent block 36 has a different shape than the block depicted in FIG. 6*a*. The transparent block 36 has a generally "T shape that extends into the hole 30 and the O-ring seal 70. The side walls 72 of the transparent block 38 are angled, thereby creating a wedge-like structure. Hence, when the transparent block 36 is compressed downwardly into the aperture 30 of the platen 16, as depicted in FIG. 8*b*, the wedge shape provided by the angle side walls 72 of the transparent block 36 interact with the elastomeric seal 70 to bias the transparent block 36 upwardly. When the downward pressure is relieved, the transparent block 36 will move upwardly.

An arrangement has been described in which a transparent block forms part of a rotatable platen suitable for use with a laser interferomatic wafer surface detecting apparatus. Relatively inexpensive polishing pads may be used with this platen, with ready assembly and easy, accurate registrability provided.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. An arrangement for polishing a workpiece in a chemical mechanical polishing apparatus, comprising:

a platen having a planar top surface, a bottom surface, an aperture extending through the platen providing a transparent channel through the platen;

a transparent block flexibly attached to and protruding from the top surface of the platen over the platen aperture to move with the platen; and a polishing pad on the top surface of the platen, the polishing pad having a planar bottom surface and a hole extending through the pad and configured to fit over the transparent block.

2. The arrangement of claim 1, further comprising a flexible coupling attached to the top surface of the platen, the flexible coupling having a support surface biased by the flexible coupling perpendicularly from the top surface of the platen toward the polishing pad.

3. The arrangement of claim 2, wherein the transparent block is fixed on the support surface of the flexible coupling.

4. The arrangement of claim 3, wherein the hole in the polishing pad is further configured to fit over the flexible coupling.

5. The arrangement of claim 4, further comprising adhesive on the support surface, wherein the hole of the polishing pad is further configured to include a shelf that fits snugly around the transparent block and is affixed to the flexible coupling support surface.

6. The arrangement of claim 5, wherein the flexible coupling includes compressible side walls extending between the top surface of the platen and the support surface.

7. The arrangement of claim 6, wherein the side walls have open slots.

8. The arrangement of claim 7, further comprising a platen window disposed in the aperture and having a top planar surface that is coplanar with the top planar surface of the platen.

9. The arrangement of claim 1, further comprising a flexible coupling between the transparent block and the platen, the flexible coupling interacting with the transparent block to bias the transparent block in a perpendicular direction from the top surface of the platen toward the polishing pad.

10. The arrangement of claim 9, wherein the flexible coupling is a seal in the platen aperture, and the transparent block has angled side walls that extend into the aperture and interact with the seal to compress the seal when the transparent block is moved in a direction perpendicularly from the polishing pad towards the bottom planar surface, the transparent block being biased towards the top surface of the platen by the seal in response to the compressing of the seal by the transparent block.

11. A platen for a chemical mechanical polishing apparatus, comprising:

a planar top surface configured for supporting a polishing pad;

a bottom surface;

an aperture extending through the platen providing a transparent channel through the platen between the bottom surface and the top surface; and a transparent block flexibly attached independently of a polishing pad and protruding from the top surface of the platen over the platen aperture to move with the platen.

12. The arrangement of claim 11, further comprising a flexible coupling attached to the top surface of the platen, the flexible coupling having a support surface biased by the flexible coupling in a perpendicular direction from the top surface of the platen.

13. The arrangement of claim 12, wherein the transparent block is fixed on the support surface of the flexible coupling.

14. The arrangement of claim 13, further comprising adhesive on the support surface for adhering a polishing pad to the support surface around the transparent block.

15. The arrangement of claim 14, wherein the flexible coupling includes compressible side walls extending between the top surface of the platen and the support surface.

16. The arrangement of claim 15, wherein the side walls have finger and slots extending between the fingers, the fingers being compressible towards one another.

17. The arrangement of claim 16, further comprising a platen window disposed in the aperture and having a planar top surface that is coplanar with the top surface of the platen.

18. The arrangement of claim 11, further comprising a flexible coupling between the transparent block and the platen, the flexible coupling interacting with the transparent block to bias the transparent block in a perpendicular direction from the top surface of the platen.

19. The arrangement of claim 11, further comprising a flexible coupling between the transparent block and the platen, the flexible coupling interacting with the transparent block to bias the transparent block in a perpendicular direction from the top surface of the platen.

20. A polishing pad for a chemical mechanical polishing apparatus that has a rotatable platen with an aperture and a transparent block attached by a flexible coupling to the platen over the aperture, the polishing pad comprising:

a planar bottom surface for seating the polishing pad on a rotatable platen;

a planar top surface forming a polishing surface for polishing a workpiece;

a hole extending through the polishing pad and opening at the top surface and the bottom surface, the hole having a first portion configured to fit snugly around a flexible coupling, and a second portion configured to fit snugly around a transparent block.

21. The polishing pad of claim 20, further comprising attachment surfaces for adhering the polishing pad to a flexible coupling.

22. The polishing pad of claim 21, wherein the polishing pad has a step that defines the first and second portions of the hole, wherein the second portion is wider than the first portion.

23. A method of forming a platen and polishing pad arrangement for a chemical mechanical polishing apparatus, comprising the steps of:

flexibly attaching a transparent block to a top surface of a platen over an aperture of the platen to form a straight transparent channel through the platen and the block, and wherein the transparent block protrudes above the top surface of the platen; and subsequently fitting a polishing pad over the transparent block and onto the platen such that the transparent channel extends completely through the polishing pad.

24. The method of claim 23, wherein the step of flexibly attaching a transparent block includes attaching a flexible coupling to a top surface of the platen and affixing the transparent block to a surface of the flexible coupling to form a light transmissive path through the flexible coupling and transparent block.

25. The method of claim 24, further comprising affixing the polishing pad onto the flexible coupling and around the transparent block to provide a snug fit of the polishing pad with the transparent block and the flexible coupling.

26. An arrangement for polishing a workpiece in a chemical mechanical polishing apparatus, comprising:

a platen having a planar top surface, a bottom surface, an aperture extending through the platen providing a transparent channel through the platen;

a transparent block attached to the platen and extending from the top surface of the platen over the aperture; and a polishing pad disposed on the top surface of the platen having a hole that receives the transparent block.

27. The arrangement of claim 26, wherein a top surface of the transparent block is coplanar with a polishing surface of the polishing pad.

28. The arrangement of claim 27 further comprising a transparent window coupled in the aperture of the platen below the transparent block.

29. The arrangement of claim 26, wherein the transparent block is coupled to the platen by a flexible member.

30. An arrangement for polishing a workpiece in a chemical mechanical polishing apparatus, comprising:

a platen having a planar top surface, a bottom surface, an aperture extending through the platen providing a transparent channel through the platen; and a transparent block attached to the platen and extending from the top surface of the platen over the aperture.

31. The arrangement of claim 30, wherein a top surface of the transparent block is coplanar with a polishing surface of the polishing pad.

32. The arrangement of claim 31 further comprising a transparent window coupled in the aperture of the platen below the transparent block.

33. The arrangement of claim 30, wherein the transparent block is coupled to the platen by a flexible member.

* * * * *

UNITED STATES PATENT AND TRADEMARK OFFICE

CERTIFICATE OF CORRECTION

PATENT NO. : 6,454,630 B1
DATED : September 24, 2002
INVENTOR(S) : Robert D. Tolles It is certified that error appears in the above-identified patent and that said Letters Patent is hereby corrected as shown below:

Column 3,
Line 50, replace “provide” with -- provided --;

Column 4,
Line 7, replace “plainer” with -- planar --;

Column 7,
Line 14, replace “T shape” with -- “T” shape --; and

Column 8,
Line 49, replace “finger” with -- fingers --.

Signed and Sealed this

Third Day of August, 2004

JON W. DUDAS
*Acting Director of the United States Patent and Trademark Office*